US005209403A

United States Patent [19]

Tarr et al.

[11] Patent Number: 5,209,403

[45] Date of Patent: May 11, 1993

[54] HIGH PRESSURE UNIT FUEL INJECTOR WITH TIMING CHAMBER PRESSURE CONTROL

[75] Inventors: Yul J. Tarr; Laszlo Tikk, Columbus, Ind.

[73] Assignee: Cummins Engine Company, Inc., Columbus, Ind.

[21] Appl. No.: 729,500

[22] Filed: Jul. 12, 1991

[51] Int. Cl.[5] ..... F02M 45/02

[52] U.S. Cl. ..... 239/91; 239/95; 239/533.8

[58] Field of Search ..... 239/88, 91, 95, 533.8

[56] References Cited

U.S. PATENT DOCUMENTS

| | | | |
|---|---|---|---|
| 4,249,499 | 2/1981 | Perr . | |
| 4,410,137 | 10/1983 | Perr | 239/95 |
| 4,410,138 | 10/1983 | Peters et al. | 239/95 |
| 4,419,977 | 12/1983 | Hillebrand | 239/95 |
| 4,420,116 | 12/1983 | Warlick | 239/95 |
| 4,463,901 | 8/1984 | Perr et al. | 239/95 |
| 4,721,247 | 1/1988 | Perr . | |
| 4,986,472 | 1/1991 | Warlick et al. . | |
| 5,033,442 | 7/1991 | Perr et al. | 239/95 X |
| 5,076,240 | 12/1991 | Perr | 239/88 X |

*Primary Examiner*—Andres Kashnikow

*Assistant Examiner*—William Grant

*Attorney, Agent, or Firm*—Sixbey, Friedman, Leedom & Ferguson

[57] ABSTRACT

A high pressure unit fuel injector includes a timing chamber formed between upper and lower plungers of the injector for controlling the timing of injection. A timing chamber relief valve is provided for performing at least one of the functions of (1) draining timing fluid from the timing chamber during an injection stroke responsive to pressure in the timing chamber for maximizing the pressure of fuel in the injection chamber under low speed operating conditions without exceeding a pressure capability of the injector under high speed operating conditions, and (2) for collapsing the timing chamber in a controlled manner at termination of injection so as to prevent secondary injection from occurring. The relief valve structure is wholly formed above the lower plunger, preferably within the upper plunger above the timing chamber. Thereby, assembly and maintenance operations on the valve are facilitated. Also, by providing the relief valve structure in an upper part of the plunger, the timing chamber assembly can be easily adapted for use on different types of injectors, including open and closed nozzle injectors.

21 Claims, 5 Drawing Sheets

HIGH PRESSURE UNIT FUEL INJECTOR WITH TIMING CHAMBER PRESSURE CONTROL

BACKGROUND OF THE INVENTION

This invention relates to high pressure unit fuel injectors wherein a fluidic timing chamber is formed between plungers of the injector for controlling the point at which the injection event occurs to thereby improve engine performance and reduce exhaust emissions. More specifically, this invention relates to injectors having a timing chamber relief valve for draining fluid from the timing chamber responsive to the fluidic pressure developed therein, for providing a sharp termination of injection and/or for obtaining increased injection pressures under slow engine speed operating conditions without exceeding the pressure capabilities of the injector at high speed operating conditions.

Commonly owned U.S. Pat. Nos. 4,721,247 to Perr and 4,986,472 to Warlick et al. describe injectors capable of operating at extremely high fuel injection pressures (on the order of 30,000 psi and above) for achieving the high levels of performance and pollution abatement demanded of modern internal combustion engines. These injectors incorporate a timing chamber formed between plungers of the injector for controlling the advance or retard of injection in relation to the pressure of a fluid, typically fuel, supplied to the timing chamber. A timing chamber relief valve is provided which serves two purposes. First, the pressure actuated valve drains timing fluid from the timing chamber, as necessary, during an injection stroke so as to achieve high injection pressures at low engine speeds while avoiding excessive injector pressures at high engine speeds. Secondly, the relief valve may function together with or in place of a spill port provided in communication with the timing chamber for collapsing the timing chamber in a controlled manner at termination of injection so as to prevent secondary injection of fuel.

The injectors of the above-mentioned patents include an injector body having a central cavity within which is received a plunger assembly comprising three plungers arranged to form the hydraulic variable timing chamber between the upper and intermediate plungers. The injection chamber is formed in the central cavity below the lower plunger.

In Perr '247, passages are provided from the timing chamber through the intermediate plunger to a valve mechanism provided between the intermediate and lower plungers. Biasing for the relief valve is provided by a single spring having the additional functions of biasing the intermediate plunger upwardly for controlling metering of fluid into the timing chamber, and controlling lifting of the lower plunger.

In Warlick et al. '472, the valve mechanism is similarly located between the lower and intermediate plungers. To improve pressure regulation using a higher spring load and to accommodate a larger area drainage passage as compared with the injector of Perr '247, a separate valve spring biases the valve mechanism toward its closed position.

As mentioned above, the injector of the Perr '247 patent uses a single spring mounted between the intermediate and lower plunger to bias the intermediate plunger upwardly. By careful design of the spring rate characteristics of the intermediate plunger biasing spring, it becomes possible to control the amount of timing fluid which is metered into the timing chamber during each cycle of injector operation by changing the pressure of the timing fluid supply to the injector. However, in the Perr '247 patent, the intermediate plunger bias spring also supplies the bias force necessary to operate the pressure actuated relief valve. Accordingly, it becomes very difficult to optimize timing fluid metering without adversely affecting the operation of the pressure actuated relief valve, and vice versa. Moreover, the size of the drain passage from the timing chamber in Perr '247 affects both the opening pressure of the pressure limiting valve and the flow rate of timing fluid drained from the timing chamber through the pressure limiting valve. These difficulties are obviated to a large extent in the injector design of Warlick et al. '472 by the provision of a relief valve spring that is separate from the timing spring, as described above.

While the injector described in the '472 patent enables the opening force of the relief valve to be adjusted without affecting the timing chamber biasing pressure, since the relief valve mechanism is still acted upon in part by the timing spring, completely independent control is not obtained. The effective biasing force acting to close the relief valve is equal to the sum of the biasing forces provided by the relief valve spring and the timing spring. Thus, since the timing spring compresses during the injection stroke, the opening force of the relief valve will vary depending upon the stroke position and movement of the lower plunger. This can make it difficult to precisely control the pressure at which the timing chamber is drained through the relief valve. Thus, there is a need for an injector having a relief valve having a bias force which is unaffected by the injection stroke of the lower plunger.

In each of the above-mentioned injectors, the timing chamber relief valve is located in a lower portion of the injector. Namely, the valve mechanism is formed between the intermediate and lower plungers and the valve biasing spring is located below the relief valve. This presents certain difficulties from a manufacturing and repair standpoint. In high pressure injection (HPI) type injectors as described above, the lower plunger is reduced substantially in diameter relative to the upper and intermediate plungers so that very high pressures in the injection chamber can be achieved without imparting such injection pressures to the timing chamber and injector drive train. More specifically, a pressure multiplication is obtained by providing the lower plunger with a pressure receiving area that is smaller than the pressure receiving areas of the upper and intermediate plungers. As a result, there is less space to accommodate the relief valve in the lower part of the plunger, i.e., below the intermediate plunger. This increases manufacturing costs and can hamper repair operations. Repair operations are further hampered by the fact that, in order to repair the relief valve, it is necessary to remove numerous injector elements, including the upper and intermediate plungers. There is, thus, a need for an injector having a timing chamber relief valve structure which facilitates assembly and repair operations.

An additional difficulty with having the relief valve mechanism formed in the lower portion of the injector is that this hampers ready adaptation of the timing chamber assembly to different types of injectors, e.g., open and closed nozzle injectors. It would be desirable if the entire timing chamber structure could be confined to an upper part of the injector such that the upper part could serve as an interchangeable injector module for use on different injectors, including both open and closed nozzle injectors.

The injectors in accordance with Perr '247 and Warlick et al. '472 have relief valve structures wherein the opening stroke of the valve seat is fixed. Thus, these references do not provide for altering the opening stroke of the relief valve in order to control more precisely the draining of fluid from the timing chamber. Moreover these references do not provide a mechanism for adjusting opening stroke independently of spring pressure.

Commonly owned U.S. Pat. No. 4,249,499 to Perr discloses a unit injector having a variable volume timing chamber formed between an upper plunger and a two-piece intermediate plunger. The intermediate plunger incorporates a pressure-sensitive relief valve for draining timing fluid from the timing chamber after the termination of injection. While the timing chamber in Perr '499 performs substantially the same function as that in Perr '247 and Warlick et al. '472, the relief valve performs only the function of controlling pressure following termination of injection. That is, the relief valve does not function to drain fluid from the timing chamber during an injection event so as to obtain an increase in injection pressures under low engine speed operating conditions without exceeding the injector pressure capability under high speed conditions.

Additionally, the relief valve means of Perr '499 is wholly contained above the lower plunger, i.e., within the two-piece intermediate plunger. In this design, the two-piece intermediate plunger adds complexity as compared with the one-piece intermediate plungers of the two previously mentioned patents and, as previously mentioned, the relief valve does not serve to control injector pressures by releasing fluid from the timing chamber during the injection event. Furthermore, since the relief valve is still below the timing chamber, difficulties are encountered in assembly and repair of the injector.

Finally, in the Perr '499 injector, the drain passages leading from the timing chamber extend to a drain conduit which is external of the engine head. Thus, the '499 patent does not teach how to utilize existing drillings in the engine head rather than an external conduit, e.g., to avoid the potential leakage to which external conduit connections are susceptible, and to avoid clutter of the engine compartment due to external fluid lines.

SUMMARY OF THE INVENTION

It is a primary object of the present invention to overcome the difficulties in the previous HPI injectors described above.

It is an object of the present invention to provide a unit injector having a timing chamber relief valve structure which, due to its location in the upper part of the injector, facilitates assembly and maintenance operations on the relief valve, and facilitates interchangeability of the timing chamber structure with various injector types including open and closed nozzle injectors.

It is a further object of the present invention to provide a timing chamber relief valve structure which enables the opening stroke of the relief valve to be readily adjusted so that the timing chamber draining rate can be precisely controlled.

Still another object of the present invention is to provide a pressure relief valve for a timing chamber wherein the opening bias of the relief valve may be modified independently of the opening stroke length of the relief valve.

It is another object of the present invention to obtain greater control over the draining of fluid from the timing chamber during an injection event by providing biasing means for the relief valve which operates completely independently of the timing spring, so that the opening force of the relief valve does not vary in relation to the stroke position and movement of the injector lower plunger.

It is a yet further object of the present invention to provide a timing chamber relief valve arrangement in an upper portion of the injector which facilitates assembly and maintenance operations, while at the same time allowing for the use of existing internal drillings in the engine head, rather than external fluid conduits, for returning fluid drained from the timing chamber to a source.

These and other objects are achieved with a fuel injector according to the present invention, having features as hereinafter described.

The fuel injector of the present invention periodically injects fuel of a variable quantity on a cycle-to-cycle basis as a function of the pressure of the fuel supplied to the injector from a source of fuel and at a variable time during each cycle as a function of the pressure of a timing fluid supplied to the injector from a source of timing fluid. The fuel injector comprises an injector body containing a central bore and an injector orifice at the lower end of the body. A reciprocating plunger assembly including an upper plunger and a lower plunger is mounted within the central bore to define a variable volume injection chamber located between the lower plunger and the lower end of the injector body containing the injector orifice. The variable volume injection chamber communicates during a portion of each injector cycle with a source of fuel, and a variable volume timing chamber located below the upper plunger communicates for a portion of each injector cycle with a source of timing fluid. In one aspect of the invention, valve means are provided for opening timing chamber draining passage means in response to an opening pressure corresponding to a predetermined pressure of the timing fluid in the timing chamber, and the valve means is formed in the upper plunger above the timing chamber.

In a preferred embodiment, the pressure sensitive valve means opens to allow drainage of the timing chamber during an injection stroke for maximizing the pressure of fuel in the injection chamber under low speed operating conditions without exceeding a pressure capability of the injector at high speed operating conditions. Furthermore, the pressure sensitive valve means may comprise an adjustment means for adjusting the opening stroke of the valve means and bias adjustment means, operating independently of the stroke adjustment means, for adjusting the predetermined pressure at which the relief valve is opened.

In another aspect of the invention, a fuel injector of the type described above is provided with valve means for opening the timing chamber draining passage means in response to an opening pressure corresponding to a predetermined pressure of the timing fluid in the timing chamber, wherein the valve means is wholly formed above the lower plunger, and the draining passage means includes a passage extending through the injector which terminates at a sidewall of the injector body for providing communication with a fluid passageway provided in an engine head.

In a still further aspect of the present invention, an injector of the type described above comprises, in addition to a pressure sensitive valve which opens to allow draining of the timing chamber during an injection stroke, first biasing means for upwardly biasing the lower plunger to control metering of timing fluid into the timing chamber and second biasing means for controlling opening of the valve means for opening the timing chamber draining passage means independently of the first biasing means, whereby an opening force of the valve means is unaffected by the stroke of and biasing force on the lower plunger.

These and other objects and features of the present invention will be evident and fully understood from the following detailed description of preferred embodiments of the invention, taken together with the accompanying drawings.

Figure 1:
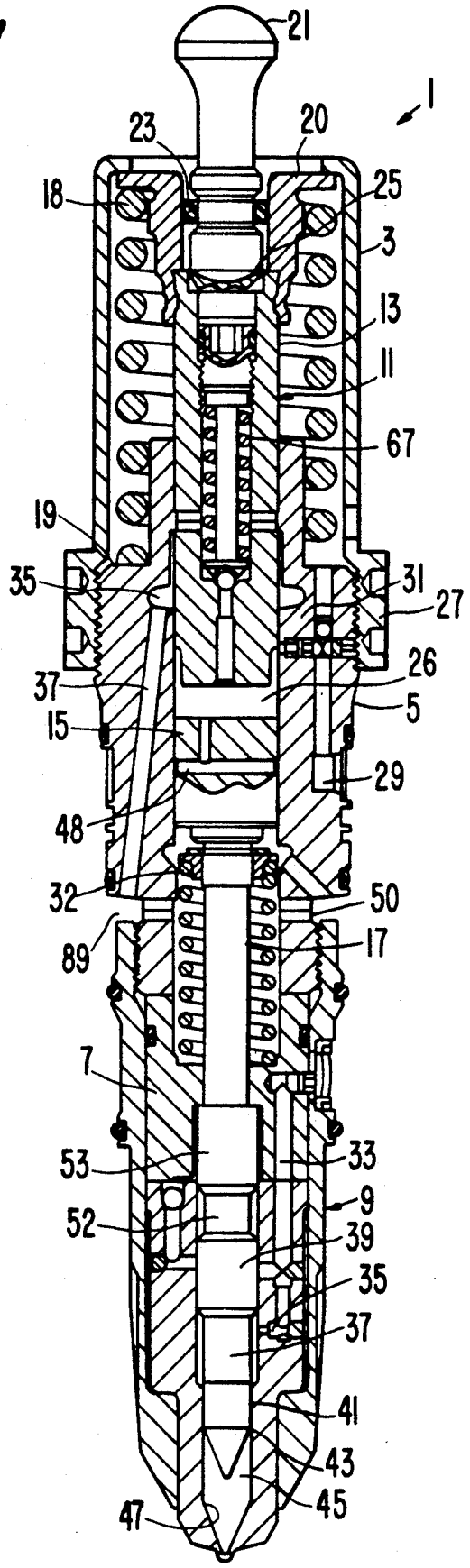
FIG. 1 is a schematic cross-sectional view of a unit fuel injector in accordance with the present invention.

FIGS. *2a–2d* are cross-sectional views of the unit injector of FIG. 1 operating in different phases.

Figure 3:
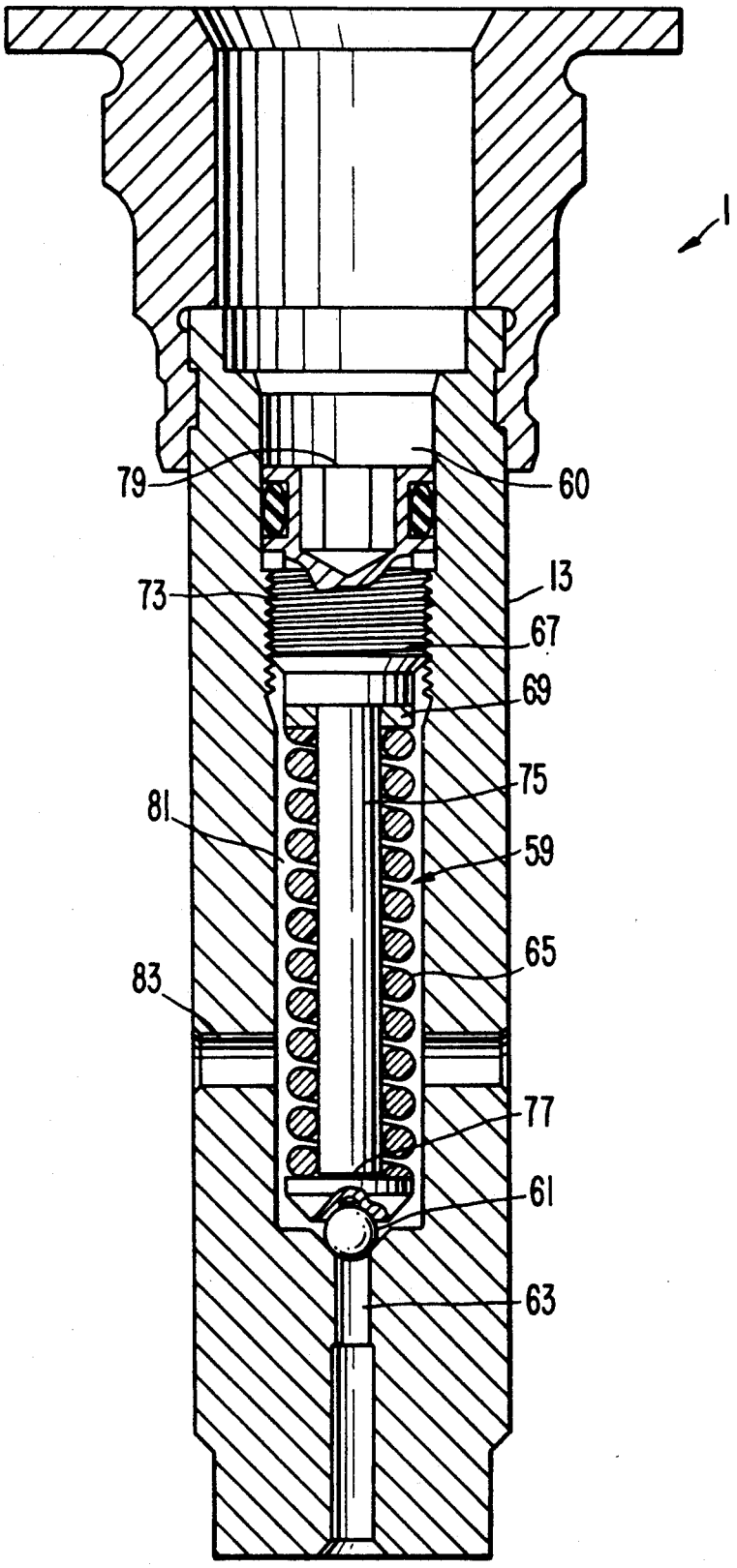

FIG. 3 is an enlarged view of the injector of FIG. 1, in the area of the upper plunger, illustrating the timing fluid draining valve arrangement of the present invention.

Figure 4:
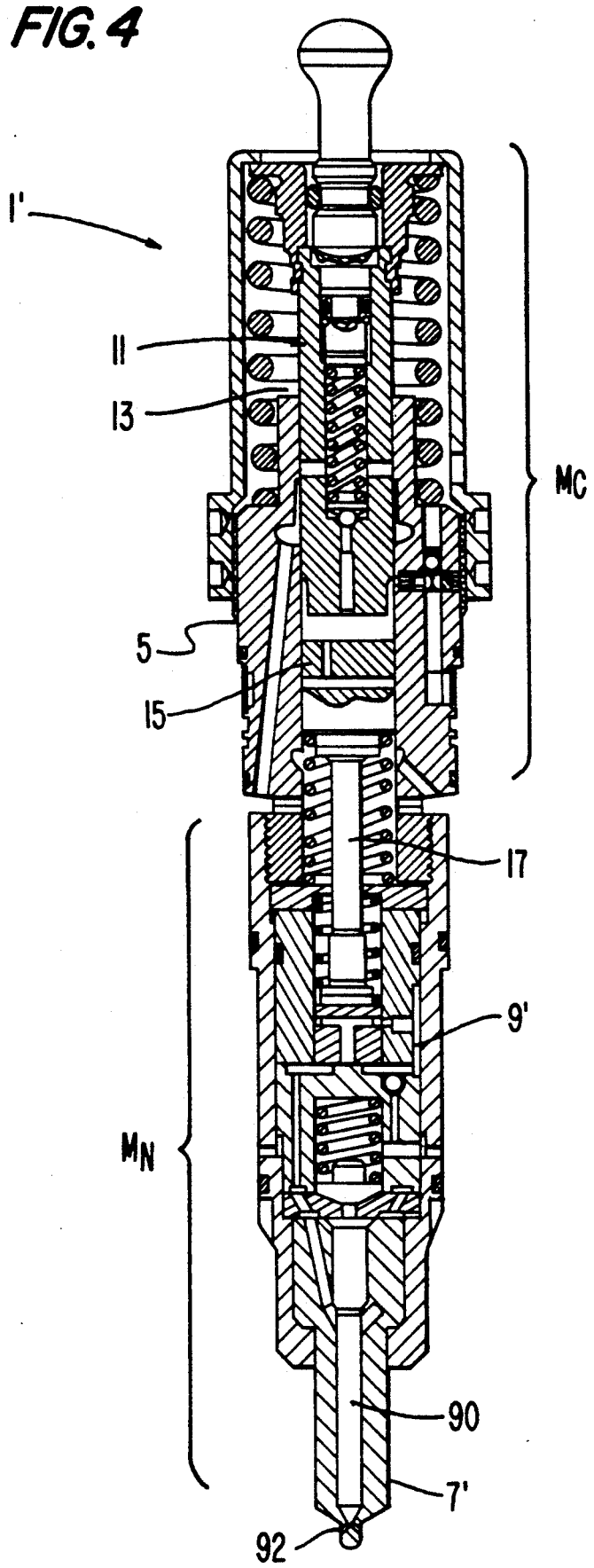

FIG. 4 is a view of a closed nozzle injector in accordance with the present invention.

DETAILED DESCRIPTION OF THE PREFERRED EMBODIMENTS

FIG. 1 illustrates a high pressure injection (HPI) type injector in accordance with the present invention. The injector designated 1, generally, is intended to be received in a conventional manner within a recess provided in the head of an internal combustion engine (not shown). The body of fuel injector 1 comprises, from top to bottom, a main return spring housing or top stop 3, an injector barrel 5, an injector cup assembly 7 and a nozzle retainer 9 for securing the injector cup assembly 7 to injector barrel 5. Injector barrel 5 and injector cup assembly 7 define an axially extending bore within which is disposed a reciprocating plunger assembly indicated generally by 11. This plunger assembly 11 includes an upper plunger 13, an intermediate plunger 15 and a lower plunger 17. Upper plunger 13 is biased upwardly by a main return spring 18 that is seated on an annular barrel 5. Top stop 3 is screwed on to an external threading 4 on the top of barrel 5 and sets the top end of the injector retraction stroke, at which spring 18 is held in a partially compressed state, between annular shoulder 19 and an injector coupling 20 that is carried by upper plunger 13. An injector link 21 is loosely secured within injector coupling 20 by retainer 23 and forms part of a conventional cam-driven injector drive train (not shown). Downward motion of injector link 21 is transmitted to upper plunger 13 through socket 25. Upper plunger 13 follows link 21 in its return stroke due to the bias of main return spring 18 being transmitted to upper plunger 13 by injector coupling 20.

Intermediate plunger 15 is able to float within the bore of injector barrel 5 between the upper plunger 13 and the lower plunger 17, and serves to control the transmission of motion for upper plunger 13 to lower plunger 17, to thereby control the fuel injection timing. More specifically, a variable volume fluidic timing chamber 26 is formed between the lower end of upper plunger 13 and the top end of the intermediate plunger 15 to which a timing fluid (e.g., fuel) is supplied via an annular recess 27 in a lower part of plunger 13 from a timing fluid throttle valve 31 in a timing fluid supply passage 29 leading to a source (not shown) of the timing fluid. The amount of fuel allowed to enter the timing chamber 26 for each injection stroke can be accurately controlled by varying the pressure of the fluid supplied through passage 29 and timing fluid throttle valve 31.

In the first of the four stages of each injection cycle, with upper plunger 13 retracted by main return spring 18 so as to uncover timing chamber fluid passage 29, the hydraulic timing fluid will exert a pressure that separates intermediate plunger 15 from upper plunger 13. As this occurs, since the lower end of the intermediate plunger 15, at this stage, is in contact with an upper end of lower plunger 17, the lower plunger 17 moves downwardly with intermediate plunger 15 against the spring force of a timing spring 32 that is seated in an upper part of injector cup assembly 7 around the top portion of lower plunger 17. The amount of separation of upper plunger 13 from intermediate plunger 15 is determined by the equilibrium between the spring force of timing spring 32 and the force produced by the timing fluid pressure acting on the pressure area of intermediate plunger 15. The greater the separation between upper plunger 11 and intermediate plunger 15, the greater the advance of injection timing.

At the same time that injection timing is being established by the feeding of timing fluid into the timing chamber 26, fuel for injection is caused to flow through a fuel supply passage 33 and outlet feed orifice 35 into an injection chamber 37 formed below a land portion 39 of lower plunger 17, spring 32 having, previously, drawn plunger 17 upwardly a sufficient extent for land portion 39 to be above feed orifice 35. The fuel then passes through a clearance space existing between an elongated lower portion 41 of lower plunger 17 and adjacent inner wall portion 43 of injector cup 9, into a lower portion 45 of injection chamber 37. During the metering of fuel, injection chamber 37 will be partially filled with a precisely metered quantity of fuel in accordance with the known "pressure/time" principle, whereby the amount of fuel actually metered is a function of a supply pressure and the total metering time that the fuel flows through feed orifice 35. FIG. *2a* shows the above-described metering and timing stage of sequential injector operation.

In the second, injection, stage illustrated in FIG. *2b*, a cam of the drive train (not shown) has caused the upper plunger 13 to be driven down. As a result, timing fluid is forced back out through throttle valve 31 until such time that throttle valve opening 31 is, as shown, closed by the sidewall of upper plunger 13. At this point, the timing fluid is trapped between upper plunger 13 and intermediate plunger 15 forming a hydraulic link which causes all three plunger elements to move in unison towards the nozzle tip. As shown in FIG. *2b*, land portion 39 of lower plunger 17 closes fuel supply orifice 35 as the plunger assembly moves downwardly. Fuel previously metered into the injection chamber 33 does not begin to be pressurized until lower plunger 17 has moved downwardly a sufficient distance to occupy that part of the injection chamber volume that was not filled with fuel. At this point, high pressure injection of fuel begins.

Injection ends sharply when the tip 46 of lower plunger 17 contacts a seat 47 formed at the lower end of injector cup assembly 7, as shown in FIG. *2c*. At this time, a third, overrun, stage is produced wherein the hydraulic link between upper plunger 13 and intermediate plunger 15 begins to collapse due to draining of the timing chamber 25. In particular, a timing chamber draining passage 48, which extends through intermediate plunger 15, comes into fluid communication with a drain passage 49 that extends through the injector barrel 5 and leads to a drainage passage provided in the form of a drilling in the engine head. This occurs just before tip 46 of lower plunger 17 contacts seat 47. During this stage, upper plunger 13 continues to move downward forcing the timing fluid out of timing chamber 26 via drain passages 48 and 49. In this regard, the flow resistance of passages 48 and 49 are chosen to insure that the pressure developed during the collapsing of timing chamber 47 is sufficient to hold lower plunger tip 46 tightly against seat 47 to prevent secondary injection.

FIG. *2d* shows a scavenge stage of injector 1. This stage occurs after all of the timing fluid has been drained from timing chamber 26 so that upper plunger 13 and intermediate plunger 15 are no longer separated.

Beginning during the injection stage shown in FIG. *2b* and continuing through both the overrun and scavenge stages of FIGS. *2c* and *2d*, scavenging of the system of gases and cooling of the injector is performed. In particular, when a recessed area 52, between lower land 39 and upper land 53 of lower plunger 17, is brought into communication with scavenging orifice 51, whereby fuel passes into the recessed area 52, then, through a passage 55 incorporating a one-way check valve 57, e.g., a ball valve, into annular volumes defined around an upper portion of upper land 53 and an upper relatively small diameter portion of lower plunger 17 within the inner walls of injector cup assembly 7, including the space which accommodates timing spring 31. Finally, the scavenging flow passes out of the injector through transverse passage 56 into the same drillings provided in the engine head for draining timing fluid from timing chamber 26. This scavenging flow continues until retraction of the plunger assembly just prior to the metering phase causes lower land portion 39 to cover scavenging orifice 51.

An additional feature of the present injector is the provision of a timing chamber relief valve for draining timing fluid from the timing chamber during an injection event so as to control the pressures developed at high engine speed operating conditions without sacrificing high injection pressures at low engine speed operating conditions. This feature will now be described with reference to the showing of upper plunger 13 in FIG. 3.

Upper plunger 13 has a timing chamber relief valve assembly 59 within a central bore 60 of plunger 13. Valve assembly 59 opens to drain timing fluid from chamber 26 (not seen in FIG. 3) when the pressure therein exceeds a predetermined maximum pressure. This advantageously allows the injector to attain high injection pressures at low engine speeds while avoiding excessive injector pressures at high engine speeds. It is also noted that relief valve 59 may serve to collapse timing chamber 26 at termination of injection, in which case draining passages 48 and 49 could be omitted. A fundamental difference between relief valve assembly 59 of the present injector and the previous relief valve configurations is that the structure of relief valve 59 is confined to an upper part of injector 1. More specifically, in the preferred embodiment of the invention, relief valve assembly 59 is wholly contained within upper plunger 13.

By positioning valve structure 59 in an upper part of injector 1, easy access to the valve assembly is possible for adjustment and/or maintenance operations. Additionally, machining and assembly operations are facilitated due to the greater size of the upper part of the injector.

As illustrated, valve assembly 59 comprises a ball valve element 61 (or the like) that is spring loaded in a direction acting to close a drain passage 63 that extends axially through a lower part of upper plunger 13 from central bore 60 and opens into timing chamber 26 by a timing spring 65. Timing spring 65 is seated on a base stop 67 and one or more shims 69 are used to precisely adjust the force exerted by spring 65 on valve element 61. Base stop 67 is threaded into threads 73 in a portion of the inner wall defining the central bore 60. Extending downwardly from base stop 67, through the center of spring 65, is a stroke limiting rod 75. By means of the threaded engagement provided at 73, the position of the end 77 of rod 75 relative to an upper surface of ball element 61 is adjustable so as to provide a means for adjusting the stroke length of relief valve assembly 59. To effect such adjustment, a socket 79 or the like is provided at the top of base stop 67 for insertion of a suitable tool.

The provision of such means for adjusting the stroke length of relief valve 59, advantageously, allows the flow rate of timing fluid from the timing chamber to be stabilized. More specifically, the size of the passage between ball valve element 61 and its seat can be fixed once a predetermined pressure necessary to push the ball valve element 61 upward into contact with end 77 of rod 75 is attained. Furthermore, adjustments in the stroke length can be attained while maintaining a given spring force by changing, in conjunction with the positioning of base stop 67, the size or number of shims 69.

In the present invention, by virtue of the threaded engagement of base stop 67 in upper plunger 13, the stroke of relief valve assembly 59 can be accurately adjusted, as can the spring force via proper selection of shim(s) 69. In this manner, both the spring force and opening stroke of the relief valve can be precisely controlled independently of each other so as to accurately control the injection pressures developed within the injector. Described below is another feature of the present invention which allows improved pressure control.

In the injector of the present invention, the opening and closing of relief valve assembly 59 is controlled independently of the stroke position and movement of upper plunger 13. Namely, the spring force acting to seat ball valve 61 remains unchanged as upper plunger 13 reciprocates up and down. This is in contrast to the arrangement of the above-mentioned Perr '247 and Warlick et al. '472 patents, wherein the opening force of the relief valve varies with the stroke position and movement of the injector plungers due to the fact that a spring corresponding to timing spring 32 acts alone or in conjunction with another spring to bias the relief valve to a closed position. By controlling the opening force of relief valve 59 completely independently of plunger stroke position and movement, it is possible to more accurately control the draining of timing fluid from timing chamber 26 during an injection stroke.

Figure 2B:
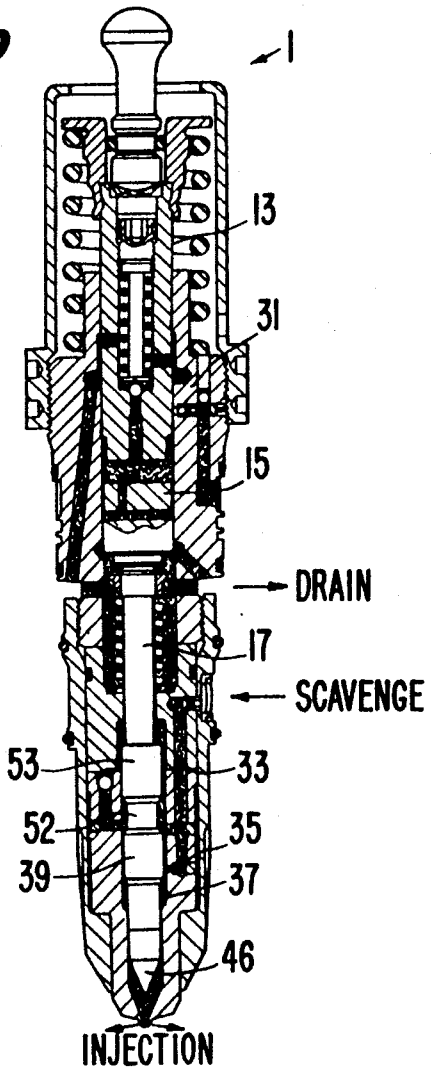
Figure 2A:
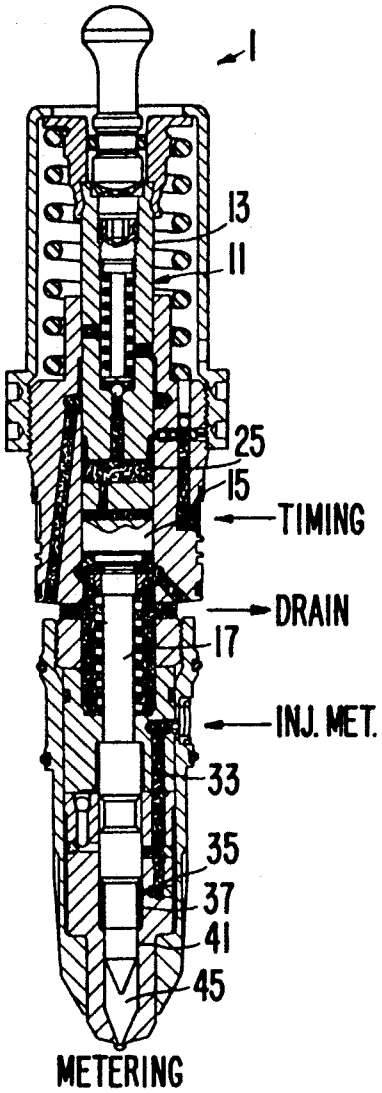
Figure 2D:
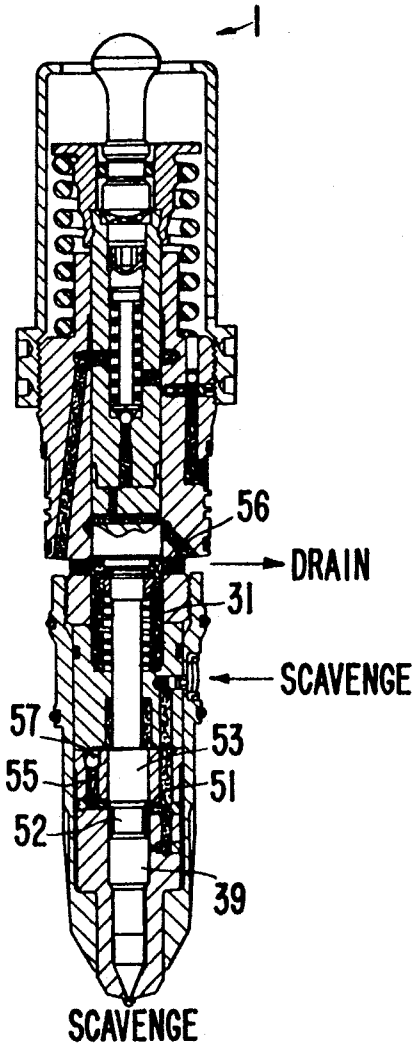
Figure 2C:
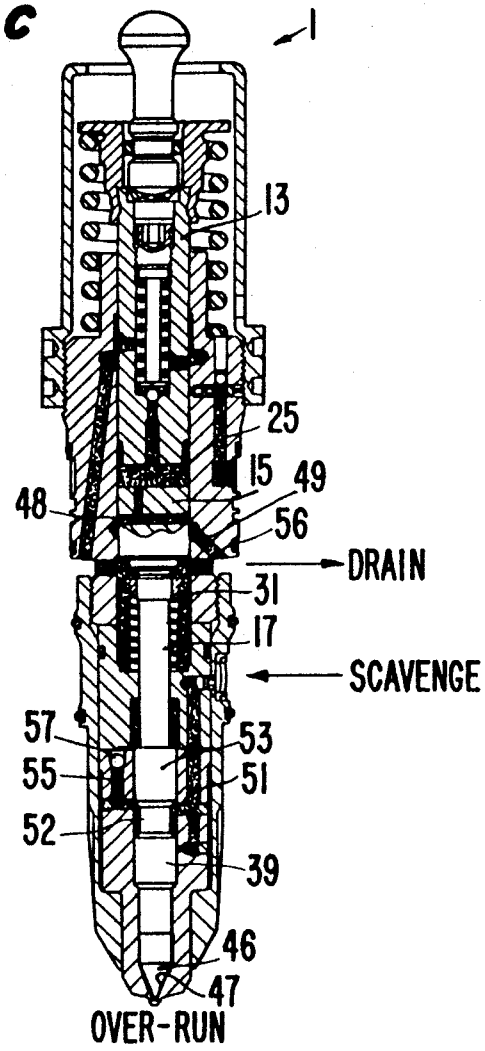

The operation of relief valve assembly 59 is now described in further detail. During the injection stage shown in FIG. 2*b*, very high pressures (on the order of 35,000 psi) are generated in injection chamber 35. The pressure developed in timing chamber 26, is significantly lower due to the difference between the pressure receiving surface areas of the intermediate plunger 15 and upper plunger 13 relative to lower plunger 17, but is nonetheless quite high. These pressures generated within injector 1 vary as a function of engine speed. As described in the above-mentioned Perr '247 patent, without the provision of a timing chamber relief valve, even if the injector is able to sustain injection chamber (sac) pressures of 35,000 psi, severe limitations are imposed on the pressures that are achievable under low speed operating conditions since, in order to attain such high pressures during low speed operating conditions, the pressures resulting at high speed operating conditions would exceed the maximum sustainable by the injector. On the other hand, by providing a timing chamber valve, it is possible to attain a substantial increase in injection pressures in the low speed operational range (to near what had been the maximum under high speed operation conditions in more conventional injectors) without exceeding the operational pressure capabilities of the injector in the high speed range. This is so because, at high speed operating conditions, when the pressure in timing chamber 26 exceeds a predetermined maximum pressure, ball valve element 61 of relief valve assembly 59 lifts from its seat to drain fluid from the timing chamber 26 in a controlled manner. Thereby, the pressure in the timing chamber is relieved and downward movement of upper plunger 13 is absorbed as chamber 26 collapses, such that the pressures developed in the injector are controlled. Thus, it is not necessary to sacrifice the pressures attainable at low engine operating speeds so as to avoid excessive pressures at high engine operating speeds.

When the predetermined maximum pressure is developed in the timing chamber 26, ball valve element 61 lifts from its seat allowing timing fluid to pass through passage 63 and continue on into spring chamber 81 and from there, out through transverse passages 83 which extend through outer walls of upper plunger 13. Passages 83 are brought into communication with annular groove 85 and angled passage 82 provided in injector barrel 5 at initiation of the injection stage. Passage 87 leads to a drainage groove 89 communicating passage 87 as well as the transverse scavenging passageway 86 with drillings provided in the engine head in which injector 1 is mounted. This arrangement advantageously avoids the external fluid conduits for draining timing fluid from a timing chamber as in the above-mentioned Perr '499 patent.

It should be appreciated that the number and placement of the various passages in the barrel 5 and upper plunger 11 shown in the drawings are not intended to serve other than an illustrative purpose since, in practice there a greater number will exist (which would unnecessarily complicate the drawings to show) and their placement will vary from engine to engine. For example, only two passages 83 are shown in FIGS. 1 and 3; however, in practice a second pair will be arranged at 90° relative to the first pair and at a different height. In FIGS. 2*a*–2*d*, the left half of upper plunger 11 represents a view displaced 90° relative to that of the right half for purpose of showing one passage 83 of each of these two pairs of passages 83.

Also, while the illustrated and preferred embodiment of the present invention, is an open nozzle injector, the present invention is not so limited. In particular, since in the present invention the means for supplying and draining fluid to timing chamber 26 is wholly contained in an upper part of the plunger, above lower plunger 17, it is contemplated that an upper timing portion of the injector, including top stop 3, injector barrel 5, upper plunger 13 and intermediate plunger 15 may be provided as an interchangeable module usable with either open or closed nozzle injector assemblies. In this respect, one example of a closed nozzle injector with a timing fluid chamber below an upper plunger which may be adapted for use with such a module in accordance with the present invention is disclosed in commonly owned U.S. Pat. No. 4,463,901.

That is, with reference to FIG. 4, the upper portion of the injector 1' constitutes a control module $M_C$ that includes the injector barrel 5, upper plunger 13 and timing plunger which is identical to that shown for the upper portion of the injector 1 in FIG. 1. On the other hand, instead of the open nozzle type lower injector portion as shown in FIG. 1, injector 1' is formed of a nozzle module $M_N$ which is constructed in the manner shown for the lower portion of the fuel injector of FIG. 2 of the above-noted U.S. Pat. No. 4,463,901, and includes a retainer 9', which forms the lower portion of the injector body, a tip nozzle 7' and a pressure responsive tip valve 90 for controlling flow out through the orifices 92 of tip nozzle 7'. Inasmuch as the further details and operation of such a closed nozzle type injector nozzle subassembly (for example, the manner in which metering and injection of fuel is obtained therewith) is fully described in U.S. Pat. No. 4,463,901, further description thereof is unnecessary, and reference can be made to that patent therefor. However, it should be recognized that the timing and injection pressure control will be regulated by the control module $M_C$ in the manner described herein instead of the manner described is said patent.

The present invention has been described and illustrated in terms of preferred embodiments thereof. Other embodiments and modifications within the scope and spirit of the present invention as defined in the appended claims will occur to those of ordinary skill in the art.

Industrial Applicability

The high pressure unit fuel injector of the present invention finds application in a large variety of internal combustion engines. One particularly important application is for small compression ignition engines adopted for automotive use such as powering automobiles. Lighter truck engines and medium range horse power engines also could benefit from the use of fuel injectors according to the present invention.

What is claimed is:

1. A fuel injector for periodically injecting fuel of a variable quantity on a cycle to cycle basis as a function of the pressure of fuel supplied to the injector from a source of fuel and at a variable time during each cycle as a function of the pressure of a timing fluid supplied to the injector from a source of timing fluid, comprising:

an injector body containing a central bore and an injector orifice at a lower end of the injector body;

a reciprocating plunger assembly including an upper plunger and a lower plunger mounted within the central bore, a variable volume injection chamber being defined between said lower plunger and the lower end of said injector body containing said injector orifice, said variable volume injection chamber communicating during a portion of each injector cycle with the source of fuel, and a variable volume timing chamber located below said upper plunger, said timing chamber communicating for a portion of each injector cycle with a source of timing fluid; and valve means for opening a timing chamber draining passage means in response to an opening pressure corresponding to a predetermined pressure of the timing fluid in said timing chamber, said valve means being formed in said upper plunger above said timing chamber.

2. Fuel injector according to claim 1, wherein said valve means opens to allow drainage of the timing chamber during an injection stroke for maximizing the pressure of fuel in the injection chamber under low speed operating conditions without exceeding a pressure capability of the injector under high speed operating conditions.

3. A fuel injector according to claim 1, wherein said injector is an open nozzle injector.

4. A fuel injector according to claim 1, wherein said draining passage means comprises at least one passage communicating said timing chamber with a drain passage in said injector body via a low pressure chamber, both of said at least one passage and said low pressure chamber being formed in said upper plunger.

5. A fuel injector according to claim 1, wherein said valve means includes biasing means for biasing a valve element of said valve means into a closed position, said biasing means being adjustable to vary an opening force of the valve means.

6. A fuel injector according to claim 1, wherein said valve means comprises an adjustment means for adjusting the opening stroke of the valve means.

7. A fuel injector according to claim 1, wherein said valve means includes a valve spring for spring-loading a valve element of said valve means in a closing direction, said valve spring being located in said upper plunger.

8. A fuel injector according to claim 7, wherein the spring force of said valve spring is adjustable to alter the opening force of the valve means.

9. A fuel injector according to claim 8, wherein at least one shim is provided for adjusting the spring force of the biasing spring, said at least one shim having a predetermined size and being disposed between said spring and a base stop therefor.

10. A fuel injector according to claim 7, wherein said valve element comprises a ball valve element.

11. A fuel injector according to claim 7, wherein said valve means further includes adjustment means for adjusting the opening stroke of the valve means.

12. A fuel injector according to claim 11, wherein said adjustment means comprises a spring base stop which is axially adjustable within the upper plunger and a shaft portion extending from said base stop, through said spring to a position adjacent the valve element, whereby the opening stroke is limited by said valve element coming into contact with an end portion of said shaft portion.

13. A fuel injector according to claim 1, further comprising an intermediate plunger mounted for reciprocating movement within said central bore between said upper plunger and said lower plunger to form said timing chamber between said upper plunger and said intermediate plunger.

14. A fuel injector, adapted to be mounted within the head of an engine containing a fluid passageway for draining fluid, for periodically injecting fuel of a variable quantity on a cycle to cycle basis as a function of the pressure of fuel supplied to the injector from a source of fuel and at a variable time during each cycle as a function of the pressure of a timing fluid supplied to the injector from a source of timing fluid, comprising:

an injector body containing a central bore and an injector orifice at the lower end of the body;

a reciprocating plunger assembly including an upper plunger and a lower plunger mounted within said bore, a variable volume injection chamber being defined between said lower plunger and the lower end of said injector body containing said injector orifice, said variable volume injection chamber communicating during a portion of each injector cycle with the source of fuel, and a variable volume timing chamber located below said upper plunger, said timing chamber communicating for a portion of each injector cycle with a source of timing fluid; and pressure-responsive valve means for opening a timing chamber draining passage means in response to an opening pressure produced by a predetermined pressure of the timing fluid in said timing chamber being exceeded, said valve means being wholly formed above said lower plunger, and said draining passage means including a passage extending through said injector body which terminates at a sidewall of said injector body for providing communication with the fluid passageway provided in the engine head.

15. A fuel injector according to claim 14, wherein said passage through the injector body terminates at a position along the sidewall of the injector adjacent to said lower plunger.

16. A fuel injector according to claim 14, wherein said valve means is formed in said upper plunger above said timing chamber.

17. A fuel injector according to claim 14, further comprising an intermediate plunger mounted for reciprocating movement within said central bore a variable volume timing chamber being defined between said upper plunger and said intermediate plunger.

18. A fuel injector according to claim 14, wherein said lower plunger and the lower end of the injector body, including said injection chamber and said injector orifice, form a first, open nozzle module; wherein said upper and intermediate plungers, said valve means and an upper portion of the injector body form a second, control module; and wherein at least one further, closed nozzle module is provided, said closed nozzle module comprising a lower injector body portion in which a lower plunger is reciprocally mounted within a variable volume injection chamber, and in which a pressure response nozzle valve is provided for controlling flow from said variable volume injection chamber through an injection orifice formed in a lower end of said lower injector body portion; and wherein either of said open nozzle and said closed nozzle modules are interchangeable usable with said control module to form said unit fuel injector.

19. A fuel injector for periodically injecting fuel of a variable quantity on a cycle to cycle basis as a function of the pressure fuel supplied to the injector from a source of fuel and at a variable time during each cycle as a function of the pressure of a timing fluid supplied to the injector from a source of timing fluid, comprising:

an injector body containing a central bore and an injector orifice at the lower end of the body;

a reciprocating plunger assembly including an upper plunger and a lower plunger mounted within said central bore, a variable volume injection chamber being defined between said lower plunger and the lower end of said injector body containing said injector orifice, said variable volume injection chamber communicating during a portion of each injector cycle with the source of fuel, and a variable volume timing chamber located below said upper plunger, said timing chamber communicating for a portion of each injector cycle with a source of timing fluid;

valve means for opening a timing chamber draining passage means in response to an opening pressure corresponding to a predetermined pressure of the timing fluid in said timing chamber, said valve means opening to allow drainage of the timing chamber during an injection stroke for maximizing the pressure of fuel in the injection chamber under low speed operating conditions without exceeding a pressure capability of the injector under high speed operating conditions;

first biasing means for upwardly biasing said lower plunger to control metering of timing fluid into said timing chamber; and second biasing means for controlling opening of said valve means independently of said first biasing means, whereby an opening force of said valve means is unaffected by the stroke of and biasing force on said lower plunger.

20. A fuel injector according to claim 19, further comprising an intermediate plunger mounted for reciprocating movement within said central bore between said upper plunger and said lower plunger to form said timing chamber between said upper plunger and said intermediate plunger.

21. A fuel injector according to claim 19, wherein said valve means is formed in said upper plunger above said timing chamber.

* * * * *